US006720530B2

(12) United States Patent
Taniguchi et al.

(10) Patent No.: US 6,720,530 B2
(45) Date of Patent: Apr. 13, 2004

(54) CERAMIC HEATER, AND GLOW PLUG USING THE SAME

(75) Inventors: Masato Taniguchi, Aichi (JP); Haruhiko Sato, Aichi (JP); Nobuyuki Hotta, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 10/135,765

(22) Filed: May 1, 2002

(65) Prior Publication Data

US 2002/0162830 A1 Nov. 7, 2002

(30) Foreign Application Priority Data

May 2, 2001 (JP) ..... 2001-135622

(51) Int. Cl.[7] ..... F23Q 7/22
(52) U.S. Cl. ..... 219/270; 123/145 A
(58) Field of Search ..... 219/267, 270; 123/145 A; 29/611

(56) References Cited

U.S. PATENT DOCUMENTS 4,425,692 A * 1/1984 Minegishi et al. ..... 29/611
4,458,637 A * 7/1984 Minegishi et al. ..... 123/145 A
4,598,676 A * 7/1986 Ito et al. ..... 123/145 A
4,725,711 A * 2/1988 Minegishi et al. ..... 219/270
5,750,958 A * 5/1998 Okuda et al. ..... 219/267
6,049,065 A * 4/2000 Konishi ..... 219/270
2002/0113052 A1 * 8/2002 Watanabe et al. ..... 219/270
2002/0134774 A1 * 9/2002 Funaki et al. ..... 219/270
2002/0148823 A1 * 10/2002 Watanabe et al. ..... 219/270
2002/0175155 A1 * 11/2002 Funaki et al. ..... 219/270

FOREIGN PATENT DOCUMENTS

JP 362175523 * 8/1987 ..... F23Q/7/00
JP 3044632 3/2000
JP 2000-130754 5/2000

* cited by examiner

*Primary Examiner*—Ehud Gartenberg
*Assistant Examiner*—Leonid M Fastovsky
(74) *Attorney, Agent, or Firm*—Sughrue Mion, PLLC

(57) ABSTRACT

A ceramic heater 1 includes a rodlike heater body 2 configured such that a ceramic resistor 10 is embedded in a ceramic substrate 13. The ceramic resistor 10 includes a front end part 11*a* and two large-diameter rodlike portions Ld. The large-diameter rodlike portions Ld form passages for supplying electricity to the front end part 11*a*, extend rearward along a direction of an axis O of the heater body 2, and have an electricity-supply sectional area greater than that of the front end part 11*a*. The large-diameter rodlike portions Ld each have a connection end part connected to the front end part 11*a*. The connection end part is formed of a first electrically conductive ceramic and constitutes a first resistor portion 11. The remaining portion of each of the large-diameter rodlike portions Ld is formed of a second electrically conductive ceramic having an electrical resistivity lower than that of the first electrically conductive ceramic and constitutes a second resistor portion 12. A joint interface 15 between the first resistor portion 1 and the second resistor portion 12 is located within the corresponding large-diameter rodlike portions Ld.

10 Claims, 10 Drawing Sheets

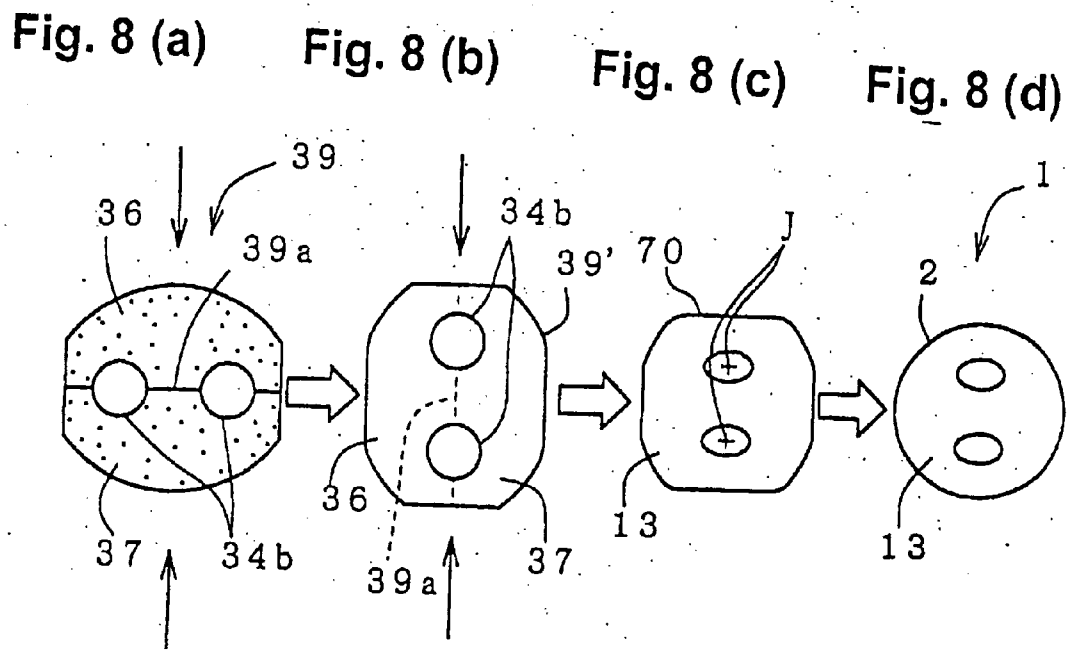
Fig. 9
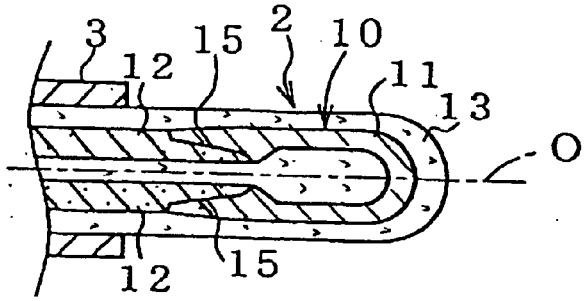

CERAMIC HEATER, AND GLOW PLUG USING THE SAME

BACKGROUND OF THE INVENTION

1. Field of the Invention

The present invention relates to a ceramic heater for use in a glow plug for preheating a diesel engine or a like device, and to a glow plug using the same.

2. Description of the Related Art

A conventionally known ceramic heater for the above-mentioned applications is configured such that a resistance-heating member formed of an electrically conductive ceramic is embedded in an insulating ceramic substrate. In such a ceramic heater, electricity is supplied to the resistance-heating member via metallic leads formed of tungsten or a like metal. However, use of the metallic leads involves a corresponding increase in the number of components, possibly resulting in an increase in the number of manufacturing steps and thus an increase in cost. In order to cope with the problem, Japanese Patent No. 3044632 discloses an all-ceramic-type heater structure, in which a first resistor portion serves as a major resistance-heating portion, and a second resistor portion formed of an electrically conductive ceramic having an electrical resistivity lower than that used to form the first resistor portion serves as an electricity conduction path to the first resistor portion, thereby eliminating the need for metallic leads.

Integration of resistor portions of different electrical resistivities facilitates implementation of a ceramic heater having a so-called self-saturation-type heat generation characteristic; i.e., a ceramic heater which functions in the following manner: at an initial stage of electricity supply, large current is caused to flow to the first resistor portion via the second resistor portion to thereby increase temperature promptly; and when the temperature rises near to a target temperature, current is controlled by means of an increase in electric resistance of the second resistor portion. Japanese Patent Application Laid-Open (kokai) No. 2000-130754 also discloses this effect as well as a ceramic heater structure in which electricity is supplied, via metallic leads, to a ceramic resistor configured such that two resistor portions of different electrical resistivities are joined together.

3. Problems to be Solved by the Invention

In ceramic heaters having the structure disclosed in the above-described patent publication, a joint interface between ceramic resistors formed of different materials is inevitably formed. Usually, electrically conductive ceramics of different electrical resistivities differ considerably from each other in coefficient of linear expansion. Accordingly, in an application involving frequent repetition of temperature rise and cooling as in the case of a glow plug, thermal stress induced by the above-mentioned difference in coefficient of linear expansion tends to concentrate at the joint interface between resistor portions of different kinds. Particularly, in the case in which a sufficiently large joint area cannot be secured, a problem arises in that strength becomes insufficient, and sufficient durability cannot be secured.

SUMMARY OF THE INVENTION

It is therefore an object of the present invention to provide a ceramic heater which exhibits excellent durability even though its ceramic resistor assumes the form of a joined body consisting of resistor portions of different kinds, as well as a glow plug using such a ceramic heater.

The above-described problems, of the prior art have been solved by providing a ceramic heater of the present invention comprises a rodlike heater body which is configured such that a ceramic resistor formed of an electrically conductive ceramic is embedded in a ceramic substrate formed of an insulating ceramic, and is configured such that a ceramic resistor formed of an electrically conductive ceramic is embedded in a ceramic substrate formed of an insulating ceramic. The ceramic heater is characterized in that the ceramic resistor comprises a front end part disposed at a front end portion of the heater body and is formed of a first electrically conductive ceramic, and two large-diameter rodlike portions joined to two end parts of the front end part as viewed along a direction of electricity supply and forming passages for supplying electricity to the front end part. Each of the large-diameter rodlike portions extends rearward along a direction of an axis of the heater body and has an electricity-supply sectional area greater than that of the front end part. Each of the large-diameter rodlike portions has a connection end part connected to the front end part. The connection end part is formed of the first electrically conductive ceramic and constitutes a first resistor portion in cooperation with the front end part. The remaining portion of each of the large-diameter rodlike portions is formed of a second electrically conductive ceramic having electrical resistivity lower than that of the first electrically conductive ceramic and constitutes a second resistor portion. A joint interface between the first resistor portion and the second resistor portion is located within the corresponding large-diameter rodlike portions.

The glow plug of the present invention comprises the above-described ceramic heater of the invention; a metallic sleeve disposed so as to circumferentially surround the heater body of the ceramic heater and such that a front end portion of the heater body projects therefrom along the direction of the axis; and a metallic shell joined to a rear end portion of the metallic sleeve as viewed along the direction of the axis and having a mounting portion formed on an outer circumferential surface thereof, the mounting portion being adapted to mount the glow plug onto an internal combustion engine.

In the above-described ceramic heater, since the front end part of the ceramic resistor has a reduced diameter, current intensively flows to the front end part, which assumes the highest temperature during operation. Therefore, a compact ceramic heater which can generate a large amount of heat can be obtained. In the present invention, the ceramic resistor assumes the form of a joined body consisting of first and second resistor portions. As described above, the joint interfaces are those of ceramic resistors formed of different materials. Accordingly, in an application involving frequent repetition of temperature rise and cooling as in the case of a glow plug, thermal stress induced by the difference in coefficient of linear expansion between the two ceramics tends to concentrate at the joint interface. However, in the present invention, by utilizing the unique configuration of a resistor in which the diameter is reduced locally at its front end part, the above-described joint interface is formed at the large-diameter rodlike portion in order to effectively increase the joint area. As a result, the margin for strength against thermal stress concentration can be increased, whereby a ceramic heater having excellent durability can be realized. Moreover, positioning of the joint interface at the large-diameter rodlike portion means that the joint interface is not formed at the small-diameter front end part. Therefore, the distance between the joint interface and the front end position of the ceramic resistor, where temperature rises to the highest level by heat generation, can be increased accordingly, thereby restraining the joint interface from being subjected to an excessively great temperature gradient and heating-cooling cycles of great temperature hysteresis.

In the claims appended hereto, reference numerals identifying components are cited from the accompanying drawings for a fuller understanding of the nature of the present invention, but should not be construed as limiting the concept or scope of the components in the claims.

BRIEF DESCRIPTION OF THE DRAWINGS

FIGS. 8(*a*) to 8(*d*) are enlarged sectional views showing a front end portion of a heater body of FIG. 1.

FIG. 9 is a sectional view showing a first modification of the front end portion of the heater body.

DESCRIPTION OF REFERENCE NUMERALS

1: ceramic heater

2: heater body

3: metallic sleeve

3*f*: front end edge

4: metallic shell

10: ceramic resistor

11: first resistor portion

11*a*: front end part

12, 12: second resistor portion

12*a*, 12*a*: exposed part

13: ceramic substrate

13*a*: cut portion

15: joint interface

15*t*: inclined face portion

K: reference plane

50: glow plug

DETAILED DESCRIPTION OF THE PREFERRED EMBODIMENTS

Embodiments of the present invention will next be described with reference to the accompanying drawings. However, the present invention should not be construed as being limited thereto.

Figure 1:
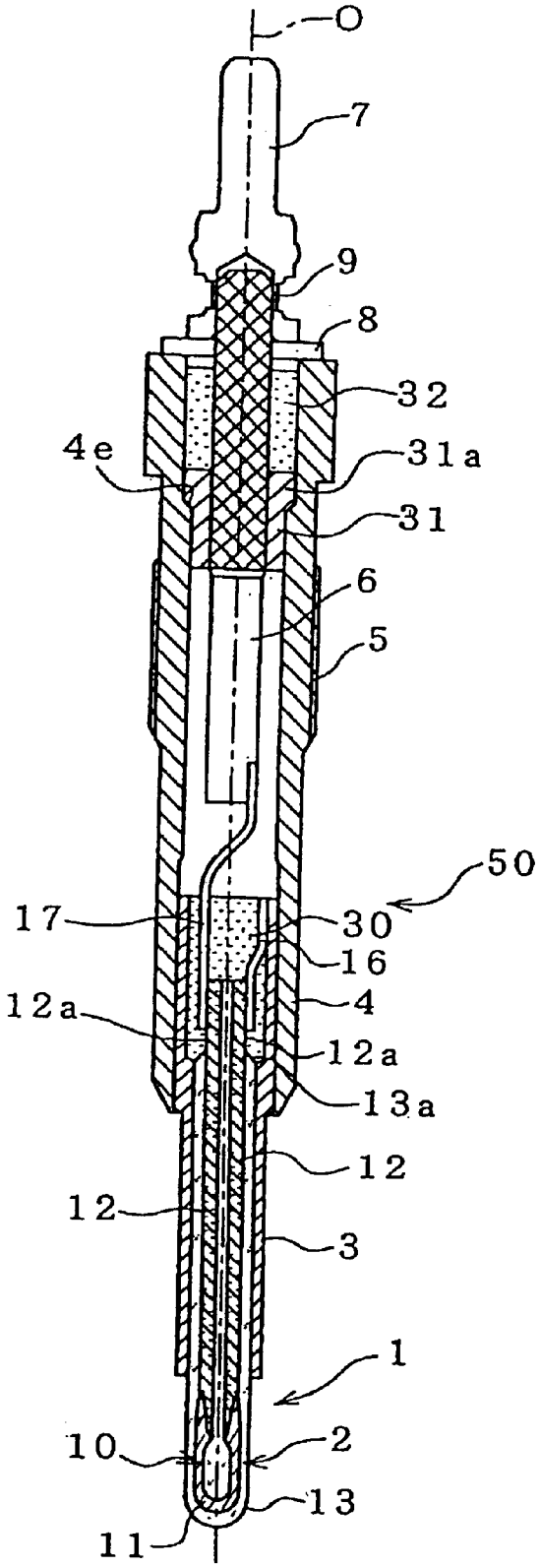
FIG. 1 is a vertical sectional view showing an embodiment of a glow plug of the present invention.

FIG. 1 shows an example of a glow plug using a ceramic heater of the present invention, illustrating an internal structure thereof. A glow plug 50 includes a ceramic heater 1; a metallic sleeve 3, which surrounds an outer circumferential surface of a heater body 2 of the ceramic heater 1 such that an end portion of the heater body 2 projects therefrom; and a cylindrical metallic shell 4, which surrounds the metallic sleeve 3. A male-threaded portion 5 is formed on the outer circumferential surface of the metallic shell 4 serving as a mounting portion for mounting the glow plug 50 onto an unillustrated engine block. The metallic shell 4 is fixedly attached to the metallic sleeve 3 by brazing, for example, so as to fill a clearance between the inner and outer circumferential surfaces of the two components or by laser-beam welding, along the entire circumference, an inner edge of an opening end of the metallic shell 4 and the outer circumferential surface of the metallic sleeve 3.

Figure 2:
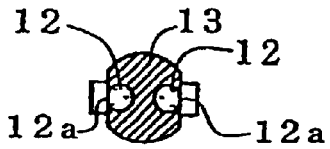
FIG. 2(*b*) is an enlarged vertical sectional view showing a ceramic heater of the embodiment and FIG. 2(*a*) is a sectional view taken along line A—A.
Figure 2:
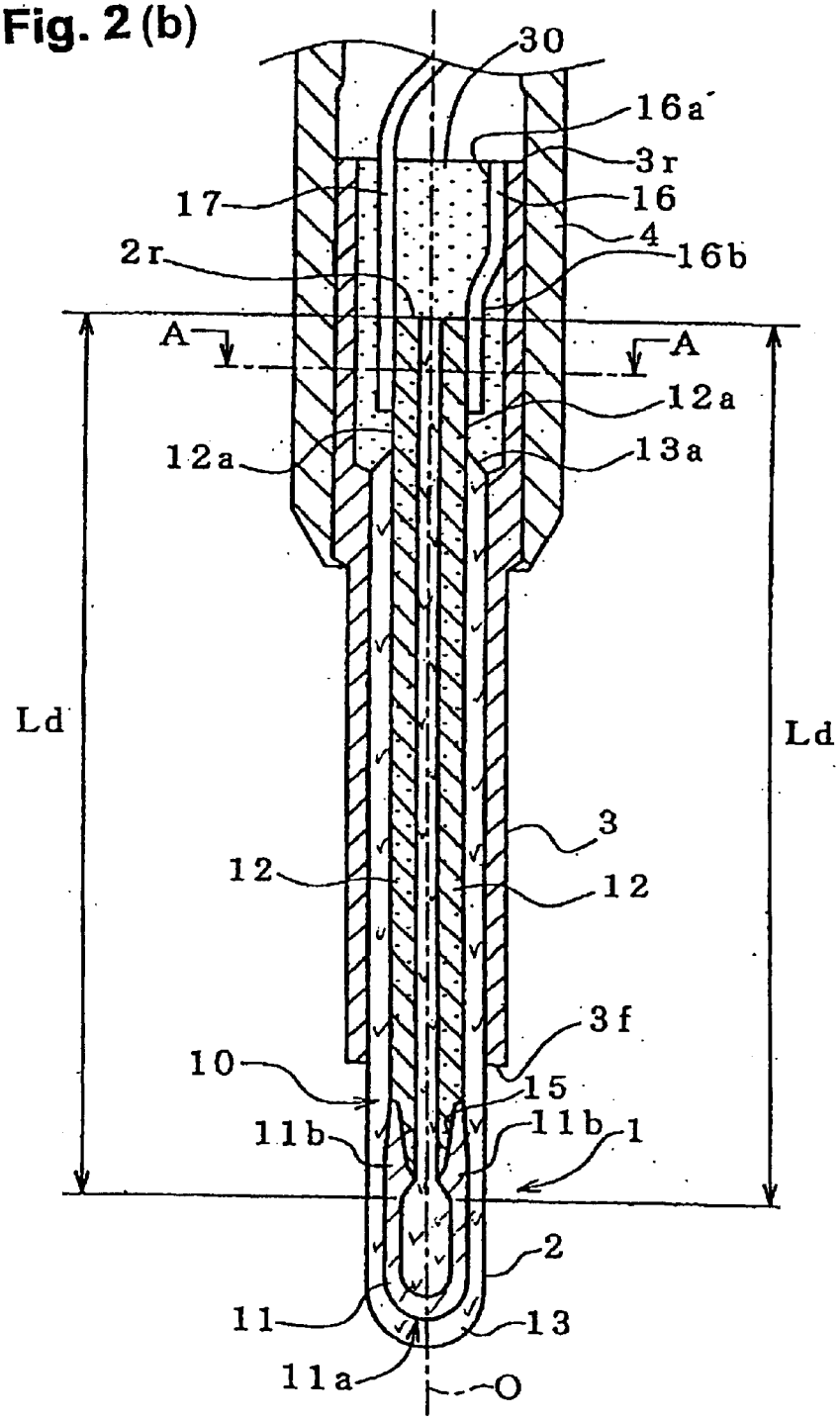

FIG. 2(*b*) is an enlarged sectional view of the ceramic heater 1 and FIG. 2(*a*) is a sectional view taken along line A—A. The heater body 2 assumes a rodlike form and is configured such that a ceramic resistor 10 formed of an electrically conductive ceramic is embedded in a ceramic substrate 13 formed of an insulating ceramic. The ceramic resistor 10 includes a first resistor portion 11, which is disposed at a front end portion of the heater body 2 and formed of a first electrically conductive ceramic, and a pair of second resistor portions 12, which are disposed on the rear side of the first resistor portion 11 so as to extend along the direction of the axis O of the heater body 2, whose front end parts are joined to corresponding end parts of the first resistor portion 11 as viewed along the direction of electricity supply, and which are formed of a second electrically conductive ceramic having an electrical resistivity lower than that of the first electrically conductive ceramic. Notably, a main-body portion of the heater body 2 excluding front and rear end parts assumes a cylindrical outer shape, and the center axis of the main-body portion is defined as the axis O.

The present embodiment employs silicon nitride ceramic as an insulating ceramic used to form the ceramic substrate 13. Silicon nitride ceramic assumes a microstructure such that main-phase grains, which contain a predominant amount of silicon nitride ($Si_3N_4$), are bonded by means of a grain boundary phase derived from a sintering aid component, which will be described below, or a like component. The main phase may be such that a portion of Si or N atoms are substituted by Al or O atoms, and may contain metallic atoms, such as Li, Ca, Mg, and Y, in the form of a solid solution. Examples of silicon nitride which has undergone such substitution include sialons represented by the following formulae.

β-sialon: $Si_{6-z}Al_zO_zN_{8-z}$ ($z$=0 to 4.2)

α-sialon: $M_x(Si,Al)_{12}(O,N)_{16}$ ($x$=0 to 2)

M: Li, Mg, Ca, Y, R (R represents rare-earth elements excluding La and Ce)

Silicon nitride ceramic can contain, as a cation element, at least one element selected from the group consisting of Mg and elements belonging to Groups 3A, 4A, 5A, 3B (e.g., Al), and 4B (e.g., Si) of the Periodic Table. These elements are present in a sintered body in the form of oxides, in an amount of 1–10% by mass as reduced to an oxide thereof and as measured in a sintered body. These components are added mainly in the form of oxides and are present in a sintered body mainly in the form of oxides or composite oxides, such as silicate. When the sintering aid component content is less than 1% by mass, the sintered body thus obtained is unlikely to become dense. When the sintering aid component content is in excess of 10% by mass, strength, toughness, or heat resistance becomes insufficient. Preferably, the sintering aid component content is 2–8% by mass. Rare-earth components for use as sintering aid components include Sc, Y, La, Ce, Pr, Nd, Sm, Eu, Gd, Tb, Dy, Ho, Er, Tm, Yb, and Lu. Particularly, Tb, Dy, Ho, Er, Tm, and Yb can be used favorably, since they have the effect of promoting crystallization of the grain boundary phase and improving high-temperature strength.

Next, as described previously, the first resistor portion 11 and the second resistor portions 12, which constitute a resistance-heating member 10, are formed of electrically conductive ceramics of different electrical resistivities. No particular limitations are imposed on a method for differentiating the two electrically conductive ceramics in electrical resistivity. Example methods include:

① a method in which the same electrically conductive ceramic phase is used, but its content is rendered different;

② a method in which electrically conductive ceramic phases of different electrical resistivities are employed; and ③ a method in which ① and ② are combined.

The present embodiment employs method ①.

The electrically conductive ceramic phase can be of a known substance, such as tungsten carbide (WC), molybdenum disilicide ($MoSi_2$), or tungsten disilicide ($WSi_2$). The present embodiment employs WC. In order to improve thermal-shock resistance by reducing the difference in linear expansion coefficient between a resistor portion and the ceramic substrate 13, an insulating ceramic phase serving as a main component of the ceramic substrate 13; i.e., a silicon nitride ceramic phase used herein, can be mixed with the electrically conductive ceramic phase. By changing the content ratio between the insulating ceramic phase and the electrically conductive ceramic phase, the electrically conductive ceramic used to form the resistor portion can be adjusted in electrical resistivity to a desired value.

Specifically, the first electrically conductive ceramic used to form the first resistor portion 11 serving as a resistance-heating portion may contain an electrically conductive ceramic phase in an amount of 10–25% by volume and an insulating ceramic phase as balance. When the electrically conductive ceramic phase content is in excess of 25% by volume, electrical conductivity becomes too high, resulting in a failure to provide a sufficient heating value. When the electrically conductive ceramic phase content is less than 10% by volume, electrical conductivity becomes too low, also resulting in a failure to provide a sufficient heating value.

The second resistor portions 12 serve as electricity conduction paths to the first resistor portion 11. The second electrically conductive ceramic used to form the second resistor portions 12 may contain an electrically conductive ceramic phase in an amount of 15–30% by volume and an insulating ceramic phase as balance. When the electrically conductive ceramic phase content is in excess of 30% by volume, densification through firing becomes difficult to achieve, with a resultant tendency toward insufficient strength. Additionally, an increase in electrical resistivity becomes insufficient even when a temperature region which is usually used for preheating an engine is reached, potentially resulting in a failure to yield a self-saturation function for stabilizing current density. When the electrically conductive ceramic phase content is less than 15% by volume, heat generation of the second resistor portions 12 becomes excessive, with a resultant impairment in heat generation efficiency of the first resistor portion 11. Preferably, in order to sufficiently yield the above-mentioned self-saturation function of flowing current, the electrically conductive ceramic phase content V1 (% by volume) of the first electrically conductive ceramic and the electrically conductive ceramic phase content V2 (% by volume) of the second electrically conductive ceramic are adjusted such that V1/V2 is about 0.5–0.9. In the present embodiment, the WC content of the first electrically conductive ceramic is 16% by volume (55% by mass), and the WC content of the second electrically conductive ceramic is 20% by volume (70% by mass) (both ceramics contain silicon nitride ceramic (including a sintering aid) as balance).

In the present embodiment, the ceramic resistor 10 is configured in the following manner. The first resistor portion 11 assumes the shape resembling the letter U, and a bottom portion of the U shape is positioned in the vicinity of the front end of the heater body 2. The second resistor portions 12 assume a rodlike shape and extend rearward along the direction of the axis O substantially in parallel with each other from the corresponding end portions of the U-shaped first resistor portion 11.

In the ceramic resistor 10, in order to cause current to intensively flow to a front end part 11*a* of the first resistor portion 11, which must assume the highest temperature during operation, the first resistor portion 11 is configured such that the front end part 11*a* has a diameter smaller than that of the opposite end parts 11*b*. A joint interface 15 between the first resistor portion 11 and each of the second resistor portions 12 is formed at each of the opposite end parts 11*b*, whose diameter is greater than that of the front end part 11*a*. The electricity-supply sectional area (an area of a cross section taken perpendicularly to the axis) of each of the second resistor portions 12 is set greater than the electricity-supply sectional area of the front end part 11*a* of the first resistor portion (herein the electricity-supply sectional area is represented by the area of a cross section taken along a plane perpendicularly intersecting a reference plane K, which will be described below). That is, the U-shaped ceramic resistor 10 is configured in the following manner. Two large-diameter rodlike portions Ld, whose diameter is greater than that of the front end part 11*a* forming a U-shape of the ceramic resistor 10, are connected to the corresponding ends of the front end part 11*a* and serve as electricity conduction paths to the front end part 11*a*. The joint interfaces 15 between the first resistor portion 11 and the second resistor portions 12 are formed at the corresponding large-diameter portions Ld.

As described previously, formation of the joint interfaces 15 at the respective large-diameter rodlike portions Ld, the area of joint can be increased, and thus the margin for strength against thermal stress concentration can be increased. Positioning of the joint interface 15 at the large-diameter rodlike portion Ld means that at least the joint interface 15 is not formed at the small-diameter front end part 11*a*. Therefore, the distance between the joint interface 15 and the front end position of the ceramic resistor 10, where the temperature rises to the highest level by heat generation, can be increased accordingly, thereby restraining the joint interface 15 from being subjected to an excessively great temperature gradient and heating-cooling cycles of great temperature hysteresis.

Figure 15:
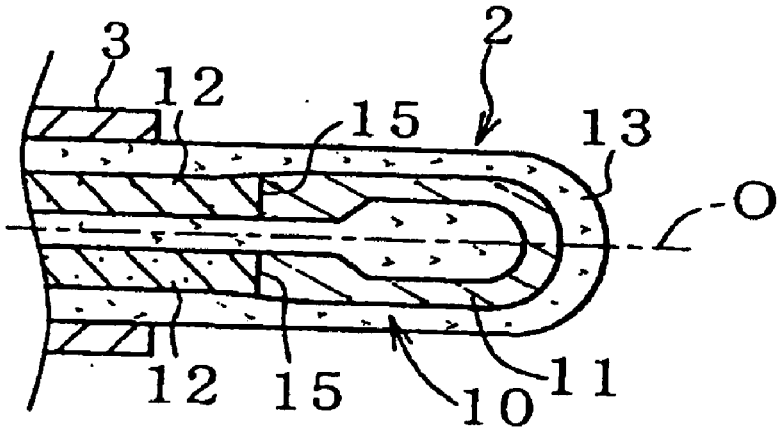
FIG. 15 is a sectional view showing a seventh modification of the front end portion.

FIG. 15 shows the simplest shape of the joint interface 15, in which the joint interface 15 is formed of a flat surface perpendicularly intersecting the axis of the heater body 2. However, the joint interface 15 employed in the embodiment of FIG. 2 has the following features.

Figure 4:
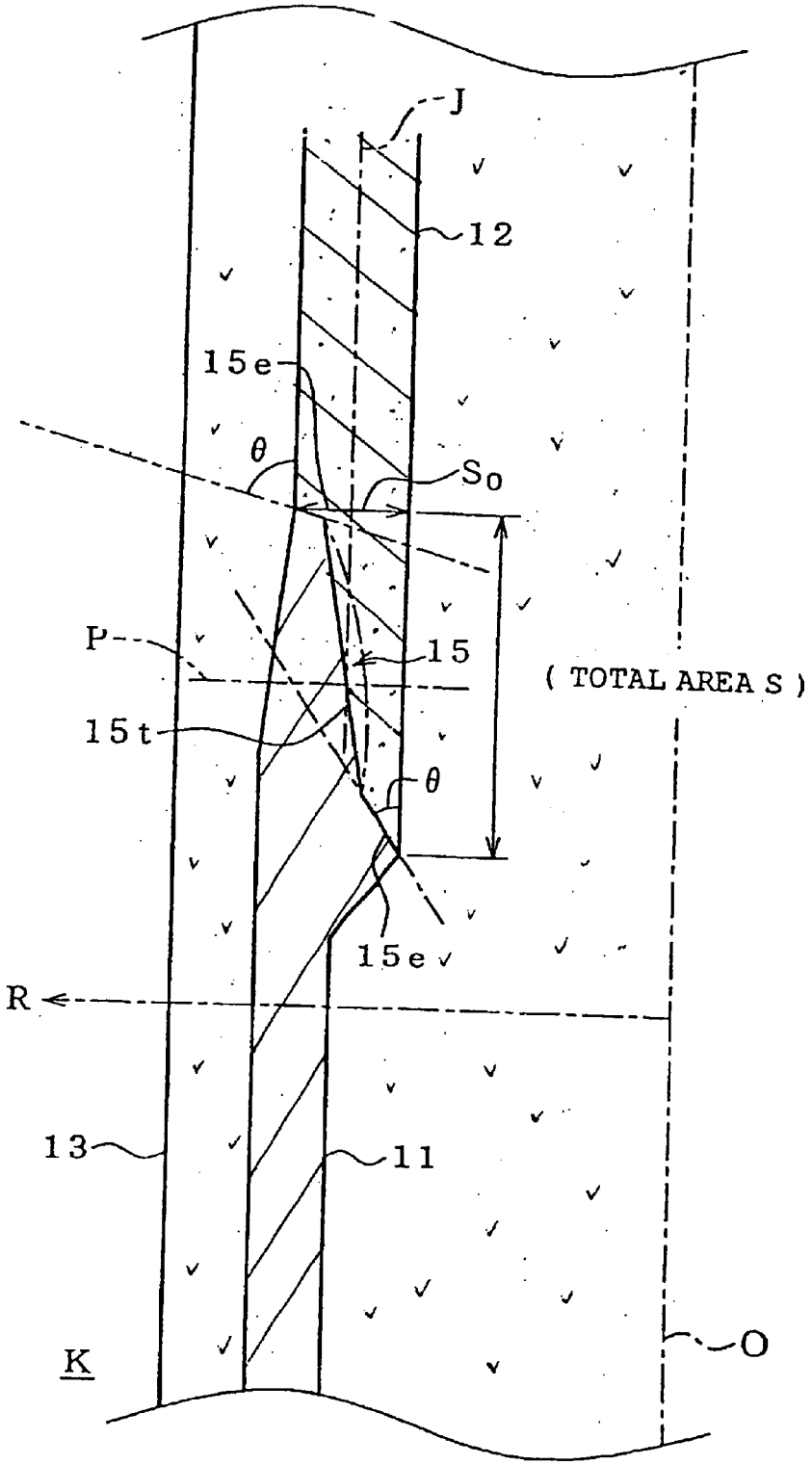
FIG. 4 is an enlarged sectional view showing the joint interface of the flow plug of FIG. 1.

① As shown in FIG. 4, the joint interface 15 includes a surface which deviates from the plane P perpendicularly intersecting the axis O of the heater body 2, thereby expanding the area of joint. Specifically, the joint interface 15 includes an inclined face portion 15*t*, which is inclined with respect to the plane P perpendicularly intersecting the axis O of the heater body 2.

② When a plane including the respective axes J of the second resistor portions 12 and the center axis O of the heater body 2 is defined as the reference plane K, the entire joint interface 15 is formed of planes perpendicularly intersecting the reference plane K. In the present embodiment, the axis O of the heater body 2 is present on the reference plane K. A part of the second resistor portion 12 other than a joint portion, which will be described below, assumes the form of a cylinder having an elliptic cross section. The axis J is defined as a line passing through geometrical centers of gravity of arbitrary cross sections of the elliptic cylinder portion perpendicularly intersecting the direction of extension of the elliptic cylinder portion.

The effect obtained by forming the joint interface as described in ① above is described below. Since the inclined face portion 15*t* is a plane that deviates from the plane P perpendicularly intersecting the axis O of the heater body 2, the area of joint is increased, and joining strength is enhanced. Since the inclined face portion 15*t* assumes a simple shape, in the course of insert molding to be described below, a molding compound is favorably distributed along the joint interface 15. As a result, the joint interface 15 becomes unlikely to suffer a defect, such as remaining bubbles. Further, since, at the inclined face portion 15*t*, the distribution ratio between a ceramic of the first resistor portion 11 and that of the second resistor portion 12 changes gradually along the direction of the axis O of the heater body 2, a joint portion is unlikely to suffer thermal stress concentration. Therefore, even when the heater is subjected to repeated thermal shock or a like condition, the joint portion can maintain good durability.

Figure 10:
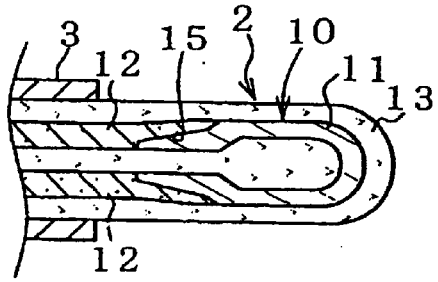
FIG. 10 is a sectional view showing a second modification of the front end portion.

The effect obtained by employing the inclined face portion 15*t* as described in ② above is described below. As shown in FIGS. 2 and 4, the inclined face portion 15*t* is formed perpendicular to the aforementioned reference plane K (in parallel with the paper on which FIG. 4 appears). The inclined face portion 15*t* can be inclined in either of the following two directions: as shown in FIG. 9, the first resistor portion 11 and the second resistor portion 12 are in contact with each other at the inclined face portion 15*t* such that the first resistor portion 11 is disposed on the outer side of the second resistor portion 12 in the radial direction R with respect to the axis O of the heater body 2; and as shown in FIG. 10, the second resistor portion 12 is disposed on the outer side of the first resistor portion 11 in the radial direction R. Particularly, when the arrangement of FIG. 9 is employed, an end part of the first resistor portion 11, which has a large heating value, is located closer to the metallic sleeve 3, which exhibits good heat transfer, thereby accelerating heat release in the vicinity of the joint interface 15 of the ceramic resistor 10. As a result, a temperature gradient in the vicinity of the joint interface 15, which is prone to insufficient joining strength, is alleviated, whereby a problem in that concentration of excessive thermal stress on the joint interface 15 can be avoided more readily. On the other hand, when the joint interface 15 is formed as described in ② above, effects peculiar to the manufacturing process are obtained. However, these effects will be described below.

Next, referring to FIG. 4, preferably, a joint portion of the ceramic resistor 10 between the first resistor portion 11 and the second resistor portion 12 (the joint portion refers to a section along the direction of the axis O where the joint interface 15 is present) is adjusted to a ratio S/SO of not less than 1.2 and not greater than 10, where S represents the total area of the joint interface 15, and SO represents the area of a cross section whose area is the smallest among those of cross sections perpendicularly intersecting the axis O of the heater body 2 at arbitrary positions. When the S/SO value is not greater than 1.2, the effect of expanding the joint interface 15 is poor. When the S/SO value is not less than 10, the joint portion becomes long, resulting in an unnecessary increase in the dimension of the ceramic heater 1.

The joint interface 15 may be entirely formed of an inclined face portion. However, in this case, for example, in manufacture of the ceramic resistor 10 by an insert molding process to be described below, a preliminary green body which is to be used as an insert is formed such that the end face thereof which is to become the joint interface 15 includes sharp end portions as represented by the dashed line in FIG. 3(*a*); as a result, chipping or a like problem becomes likely to occur. In order to prevent this problem, the end portions of the joint interface may each assume the form of a gently inclined face 15*e* or a face perpendicularly intersecting the axis J of the second resistor portion 12.

Referring to FIG. 4, preferably, when, on a section taken along an arbitrary plane including the axis J of the second resistor portion 12, θ represents the crossing angle between an outline of the resistor 10 and a line representing the joint interface 15, a θ value as measured on a section taken along a plane (in FIG. 4, the plane is the reference plane K) which minimizes θ is not less than 20°. Employment of such a θ value prevents the occurrence of chipping or a like problem on the above-described green body. Notably, it is self-evident that when a plane perpendicularly intersecting the axis J is employed, θ assumes a maximum value of 90°.

In view of simplifying the shape, the inclined face portion 15*t* preferably assumes a planar shape as shown in FIG. 4. However, so long as the effect of an inclined face portion is not impaired, the inclined face portion 15*t* may be curved at a slight radius of curvature as represented by the dash-and-dot line in FIG. 4, whereby the area of joint can be further increased.

Referring back to FIG. 2, a pair of second resistor portions 12 of the ceramic resistor 10 are exposed, from the surface of the heater body 2, at axially rear end parts thereof to thereby form respective exposed parts 12*a*, and the exposed parts 12 serve as joint regions where electricity-conduction terminal elements 16 and 17 are joined to the ceramic resistor 10. This structure does not require embedding electricity conduction lead wires in the heater body 2 and allows the heater body 2 to be formed entirely of ceramic, thereby reducing the number of manufacturing steps. In the case of a structure in which metallic lead wires are embedded in ceramic, when a heater drive voltage is applied at high temperature, the metallic lead wires wear down because of the so-called electromigration effect. As a result of the electromigration effect, atoms of metal used to form the metallic lead wires are forcibly diffused toward ceramic upon being subjected to an electrochemical drive force induced by an electric field gradient associated with the application of a voltage, resulting in the likelihood of breaking of the metallic lead wires or a like problem. By contrast, according to the above-described structure, the electricity-conduction terminal elements 16 and 17 are joined to the exposed parts 12*a* of the second resistor portions 12, which serve as electricity conduction paths, without embedding; thus, the structure is intrinsically not prone to the above-described electromigration.

According to the present embodiment, the ceramic substrate 13 is partially cut off at a rear end portion thereof as viewed along the direction of the axis O of the heater body 2 to thereby form a cut portion 13*a*, where the rear end parts of the second resistor portions 12 are exposed. Thus, the above-described exposed parts 12*a* can be simply formed. Such a cut portion 13*a* may be formed at the stage of a green body or may be formed by grinding or a like process after firing.

The electricity-conduction terminal elements 16 and 17 are made of metal, such as Ni or an Ni alloy, and are brazed to the corresponding second resistor portions 12 at the exposed parts 12*a*. Since metal and ceramic are to be brazed, preferably, an active brazing filler metal suited for such brazing is used; alternatively, an active metal component is deposed on ceramic for metallization by vapor deposition or a like process, and subsequently brazing is performed using an ordinary brazing filler metal. An applicable brazing filler metal can be of a known Ag type or Cu type, and an applicable active metal component is one or more elements selected from the group consisting of Ti, Zr, and Hf.

As shown in FIG. 1, a metallic rod 6 for supplying electricity to the ceramic heater 1 is inserted into the metallic shell 4 from a rear end thereof as viewed along the direction of the axis O and is disposed therein while being electrically insulated therefrom. In the present embodiment, a ceramic rig 31 is disposed between the outer circumferential surface of a rear portion of the metallic rod 6 and the inner circumferential surface of the metallic shell 4, and a glass filler layer 32 is formed on the rear side of the ceramic ring 31 to thereby fix the metallic rod 6 in place. A ring-side engagement portion 31*a*, which assumes the form of a large-diameter portion, is formed on the outer circumferential surface of the ceramic ring 31. A shell-side engagement portion 4*e*, which assumes the form of a circumferentially extending stepped portion, is formed on the inner circumferential surface of the metallic shell 4 at a position biased toward the rear end of the metallic shell 4. The ring-side engagement portion 31*a* is engaged with the shell-side engagement portion 4*e*, to thereby prevent the ceramic ring 31 from slipping axially forward. An outer circumferential surface of the metallic rod 6 in contact with the glass filler layer 32 is knurled by knurling or a like process (in FIG. 1, the hatched region). A rear end portion of the metallic rod 6 projects rearward from the metallic shell 4, and a metallic terminal member 7 is fitted to the projecting portion via an insulating bushing 8. The metallic terminal member 7 is fixedly attached to the outer circumferential surface of the metallic rod 6 in an electrically continuous condition by a circumferentially crimped portion 9.

In the ceramic resistor 10, one second resistor portion 12 is joined at the exposed part 12*a* thereof to the grounding electricity-conduction terminal element 16 to thereby be electrically connected to the metallic shell 4 via the metallic sleeve 3, whereas the other second resistor portion 12 is joined at the exposed part 12*a* thereof to the power-supply-side electricity-conduction terminal element 17 to thereby be electrically connected to the metallic rod 6. In the present embodiment, the exposed part 12*a* of the second resistor portion 12 is formed at a rear end portion of the outer circumferential surface of the heater body 2, and the heater body 2 is disposed such that a rear end face 2*r* thereof is located frontward from a rear end face 3*r* of the metallic sleeve 3 as viewed along the direction of the axis O. The grounding metallic lead element 16 is disposed in such a manner as to connect the exposed part 12*a* of the heater body 2 and a rear end portion of the inner circumferential surface of the metallic sleeve 3. A portion of the metallic sleeve 3 which is located rearward from the front end edge of the cut portion 13*a* of the heater body 2, which will be described below, is filled with glass 30. As a result, the grounding electricity-conduction terminal element 16 is substantially entirely embedded in the glass 30 and is thus unlikely to suffer breaking, defective contact, or a like problem even when vibration or a like disturbance is imposed thereon. In the present embodiment, the grounding electricity-conduction terminal element 16 is a strap-like metallic member. A front end portion of one side 16*a* of the grounding electricity-conduction terminal element 16 is brazed to the corresponding second resistor portion 12, whereas a rear end portion of an opposite side 16*b* is joined to a rear end portion of the inner circumferential surface of the metallic sleeve 3 by, for example, brazing or spot welding. Thus, the grounding electricity-conduction terminal element 16 can be easily joined.

Figure 11:
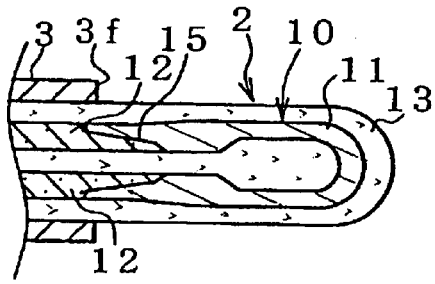
FIG. 11 is a sectional view showing a third modification of the front end portion.
Figure 12:
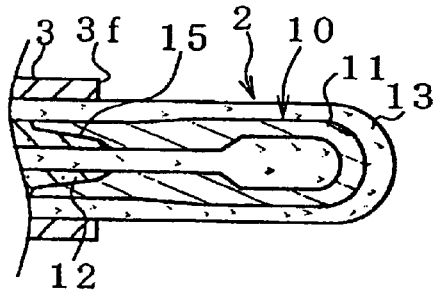
FIG. 12 is a sectional view showing a fourth modification of the front end portion.

As shown in FIGS. 11 and 12, when the ceramic resistor 10 is configured such that the joint interface 15 between the first resistor portion 11 and the second resistor portion 12 is located partially (FIG. 11) or entirely (FIG. 12) rearward from a front end edge 3*f* of the metallic sleeve 3 as viewed along the direction of the axis O of the heater body 2, an end part of the first resistor portion 11 is covered with the metallic sleeve 3, whereby the above-mentioned heat release effect is enhanced. In this case, as shown in FIG. 11, when the joint interface 15 is partially located within the metallic sleeve 3, a problem in that heat generated by the first resistor portion 11 is excessively released to the metallic sleeve 3 is unlikely to arise, whereby heat generation efficiency of the ceramic heater 1 is favorably maintained at a good level.

Figure 5:
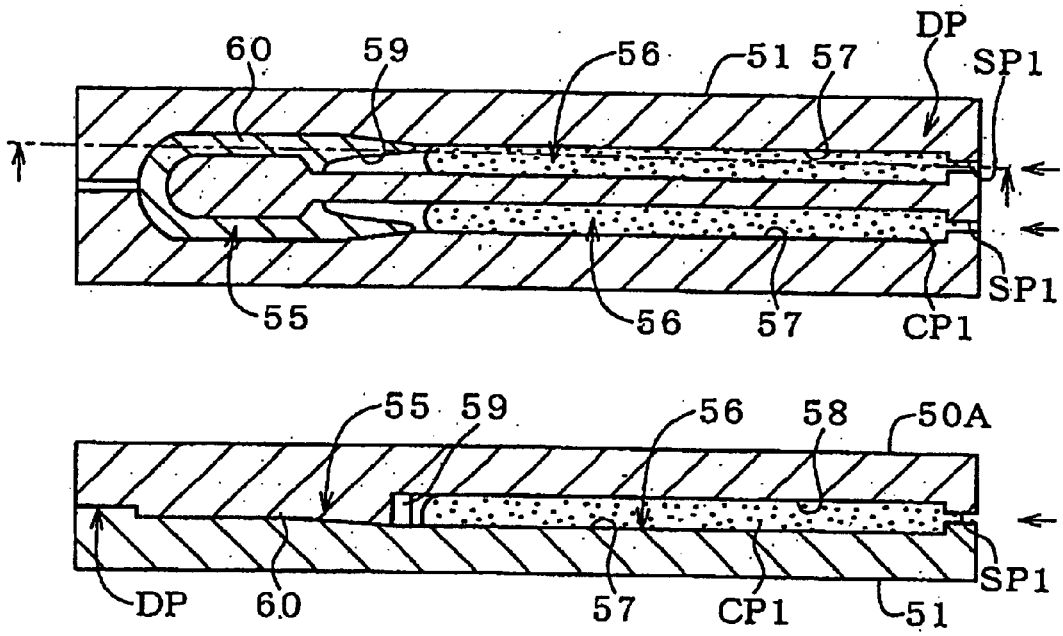
FIGS. 5(*a*) and 5(*b*) are explanatory views showing an example of a process for forming a resistor green body of the glow plug of FIG. 1 by insert molding.
Figure 5:
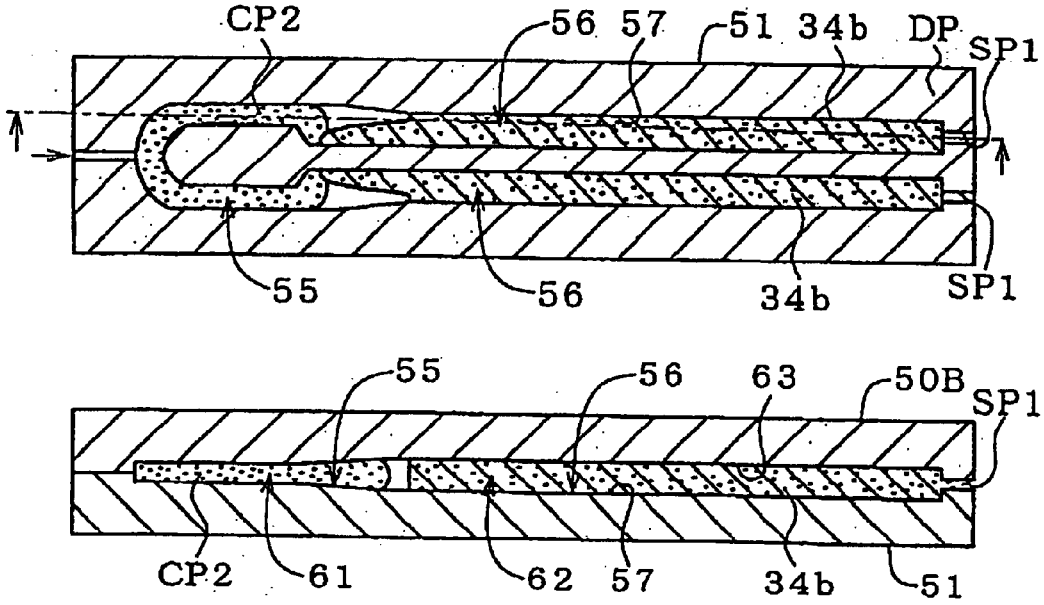

An example method for manufacturing the ceramic heater 1 (heater body 2) will next be described. First, a resistor green body 34 (FIG. 6), which is to become the ceramic resistor 10, is formed by injection molding; specifically, insert molding. FIG. 5 shows an example of a molding process. Molding uses a split mold having an injection cavity for molding the resistor green body 34. The split mold is composed of a first mold 50A or 50B and a second mold 51. The injection cavity is divided into a cavity formed in the first mold 50A or 50B and a cavity formed in the second mold 51, along a dividing plane DP corresponding to the reference plane K.

The second mold 51 has a second integral injection cavity 57 formed therein. The second integral injection cavity 57 is integrally composed of a cavity 55 for molding the first resistor portion 11 (FIG. 2) and a cavity 56 for molding the second resistor portions 12 (FIG. 2). A preliminary-molding mold 50A and an insert-molding mold 50B are prepared to serve as the first mold. The preliminary-molding mold 50A has a partial injection cavity 58 formed therein for molding preliminary green bodies 34*b*, which is to become the second resistor portions 12. The preliminary-molding mold 50A includes a filler portion 60 for filling, when mated with the second mold 51, a portion 55 of the second integral injection cavity 57 which is not used for molding the preliminary green bodies 34*b*. The filler portion 60 has an adjacent face 59 adjacent to the partial injection cavity 58 and perpendicular to the dividing plane DP. The insert-molding mold 50B has a first integral injection cavity 63 formed therein. The first integral injection cavity 63 is integrally composed of a cavity 61 for molding the first resistor portion 11 (FIG. 2) and a cavity 62 for molding the second resistor portions 12 (FIG. 2).

First, as shown in FIG. 5(*a*), the second mold 51 and the preliminary-molding mold 50A are mated with each other, and a molding compound CP1 is injected to thereby mold the preliminary green bodies 34*b*. The molding compound CP1 is prepared by the steps of mixing a tungsten carbide powder, a silicon nitride powder, and a sintering aid powder so as to obtain the composition of the second electrically conductive ceramic, thereby yielding a material ceramic powder; kneading a mixture of the material ceramic powder and an organic binder to obtain a compound; and fluidizing the compound by applying heat.

Upon completion of injection molding of the preliminary green bodies 34*b*, the split mold is opened. Since the joint interface 15 between the first resistor portion 11 and the second resistor portion 12 is only formed of planes perpendicular to the reference plane K; i.e., the dividing plane DP, the split mold can be readily opened without inflicting damage to the preliminary green bodies 34*b*, by separating the preliminary-molding mold 50A from the second mold 51 in the direction perpendicular to the dividing plane DP.

Next, as shown in FIG. 5(*b*), the second mold 51 and the insert-molding mold 50B are mated with each other while the preliminary green bodies 34*b* are disposed as inserts in the corresponding cavity portions 56 and 62 of the first integral injection cavity 63 and the second integral injection cavity 57. A molding compound CP2 is injected into the remaining cavity portions 55 and 61 to thereby yield the resistor green body 34 through integration of an injection-molded portion 34*a* (FIG. 6) with the preliminary green bodies 34*b*. The molding compound CP2 is similar to the molding compound CP1; however, a material powder for the molding compound CP2 is blended so as to obtain the composition of the first electrically conductive ceramic. At this time, while the preliminary green bodies 34*b* obtained in the step of FIG. 5(*a*) are left in the second mold 51, and the preliminary-molding mold 50A is replaced with the insert-molding mold 50B, followed by insert molding, whereby working efficiency is further enhanced.

The molding sequence of the first resistor portion 11 and the second resistor portions 12 can be reversed. In this case, a preliminary-molding mold must include a filler portion which fills the cavity portion 56 of the second integral injection cavity 57. In the present embodiment, as shown in FIG. 2, the first resistor portion 11 is smaller in dimension as measured along the direction of the axis O of the heater body 2 than the second resistor portion 12. In this case, in manufacture of the resistor green body 34, the preliminary green bodies 34*b* correspond to the second resistor portions 12, thereby yielding the following advantage. When portions corresponding to the second resistor portions 12 are to be injection-molded, as shown in FIG. 5(*a*), forming sprues SPI for injecting a compound therethrough at a longitudinally rear end portion of the cavity is favorable for uniform injection of the molding compound CP1 into the cavity. At this time, when the second resistor portions 12 are long, the moving distance of the fluidized molding compound CP1 becomes considerably long. As a result, until the molding compound CP1 reaches the joint interface position, the temperature of a molten binder unavoidably drops to a certain extent. However, since the dimension of the first resistor portion 11 is small, the moving distance of the fluidized molding compound CP2 is short, and therefore temperature drop becomes unlikely. Thus, when two green bodies are to be integrated at the joint interface through insert molding, the insert molding process of the present embodiment—in which the first resistor portion 11 is molded while the previously molded second resistor portions 12 are used as inserts—allows the molding compound CP2 to reach the joint interface at higher temperature, thereby providing a strong joint with few defects.

Figure 6:
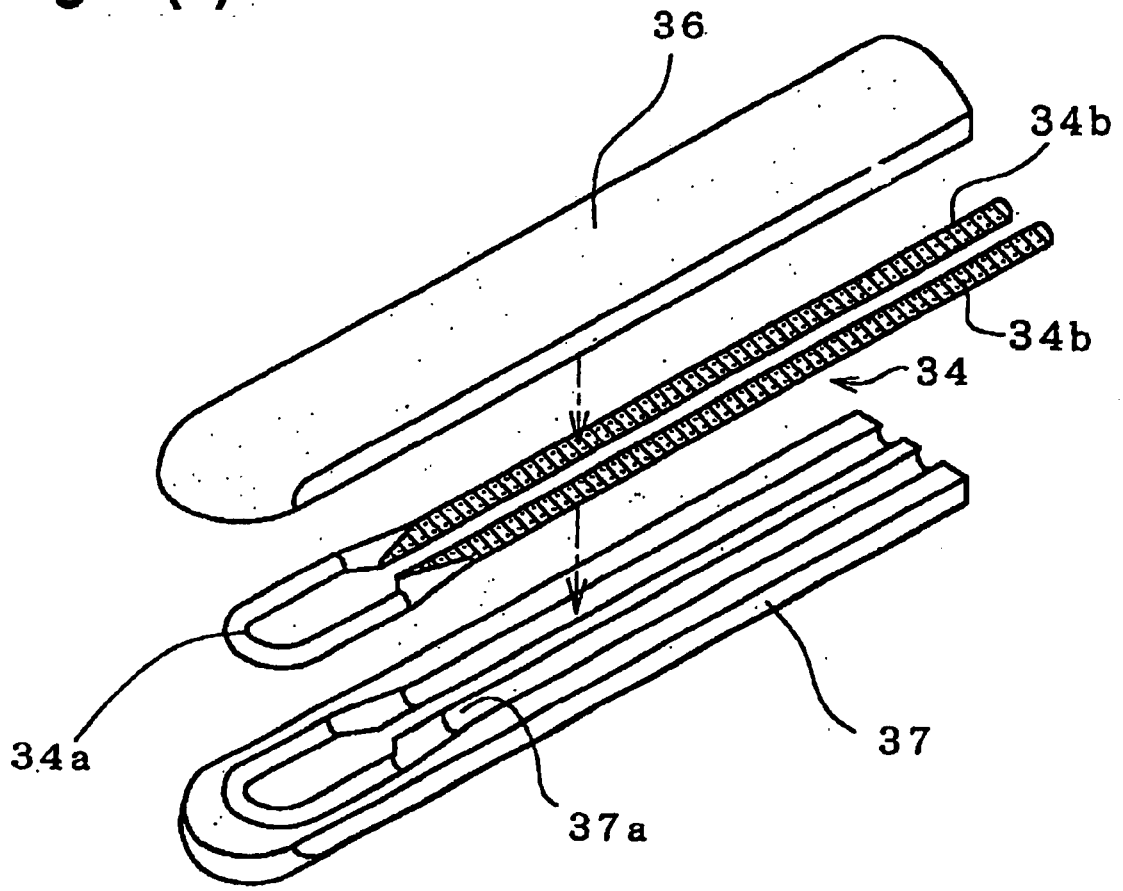
FIGS. 6(*a*) and 6(*b*) are an explanatory views showing a process for forming a ceramic heater by use of the resistor green body of FIG. 5.
Figure 6:
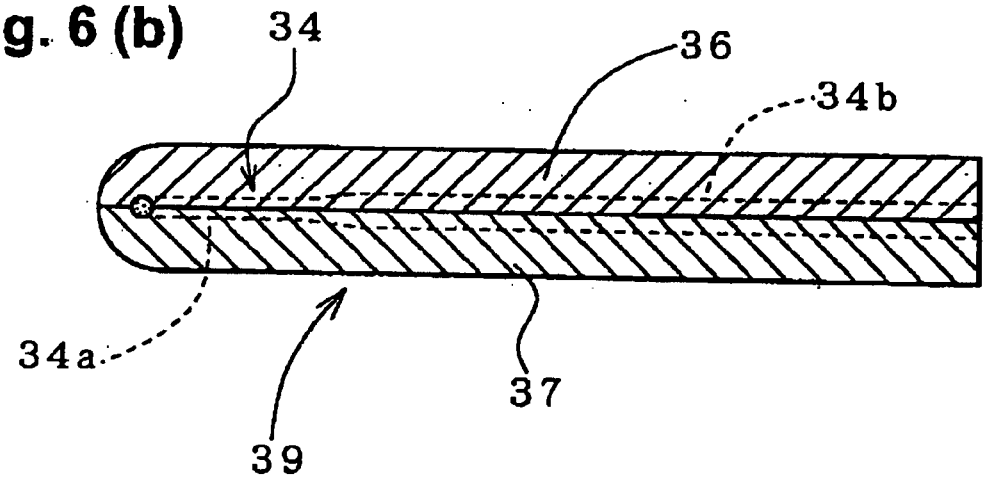

In relation to the above-described formation of the resistor green body 34, a material powder for forming the ceramic substrate 13 is die-pressed beforehand into half green bodies 36 and 37, which are upper and lower substrate green bodies formed separately, as shown in FIG. 6(*a*). A recess 37*a* (a recess formed on the half green body 36 not shown in FIG. 6(*a*)) having a shape corresponding to the resistor green body 34 is formed on the mating surface of each of the half green bodies 36 and 37. Next, the half green bodies 36 and 37 are joined together at the above-mentioned mating surfaces, while the resistor green body 34 is accommodated in the recesses 37*a*. Then, as shown in FIG. 7(*a*), an assembly of the half green bodies 36 and 37 and the resistor green body 34 is placed in a cavity 61*a* of a die 61 and is then pressed by means of punches 62 and 63, thereby obtaining a composite green body 39 as shown in FIG. 6(*b*).

In order to remove a binder component and the like, the thus-obtained composite green body 39 is calcined at a predetermined temperature (e.g., approximately 600° C.) to thereby become a calcined body 39' (notably, a calcined body is considered a composite green body in the broad sense) shown in FIG. 6(*b*). Subsequently, as shown in FIG. 7(*b*), the calcined body 39' is placed in cavities 65*a* of hot-pressing dies 65 made of graphite or a like material.

Figure 7:
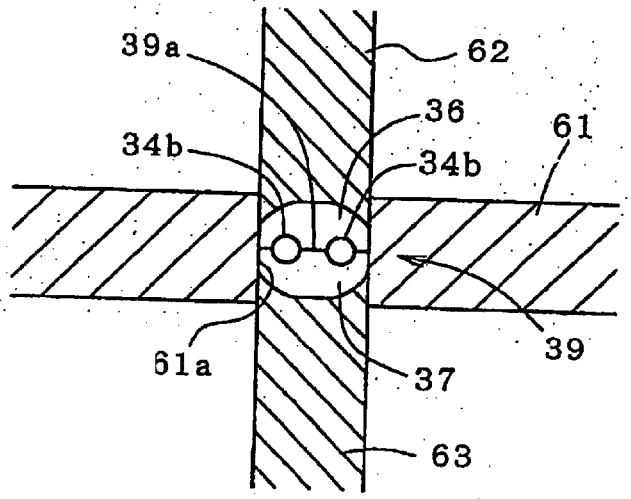
FIGS. 7(*a*) and 7(*b*) are explanatory views showing a process subsequent to that of FIG. 6.
Figure 7:
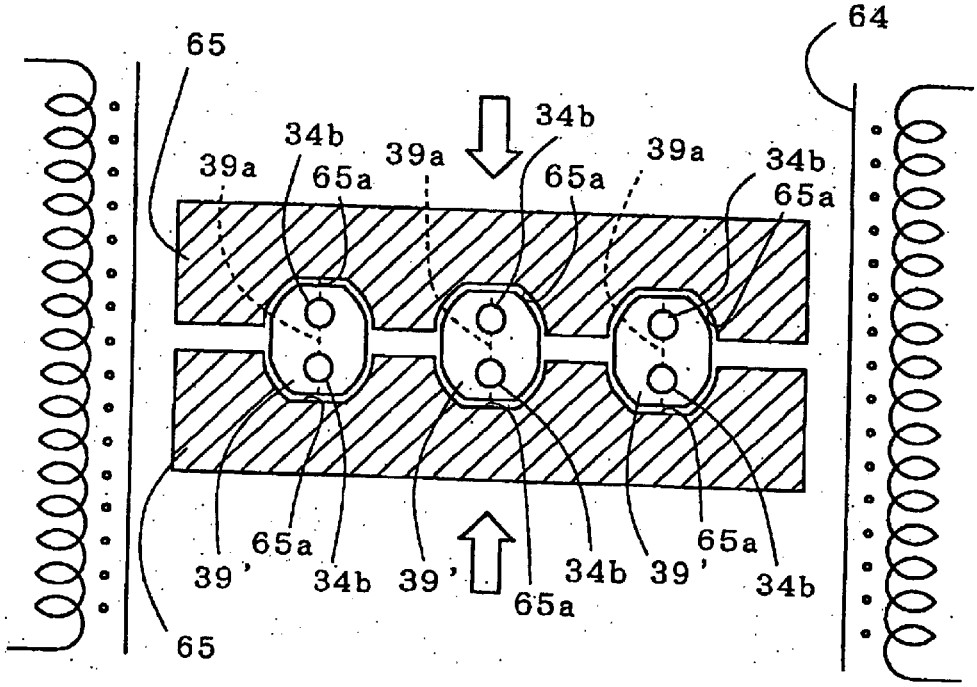

As shown in FIG. 7(*b*), the calcined body 39' held between the pressing dies 65 is placed in a kiln 64. In the kiln 64, the calcined body 39' is sintered at a predetermined firing retention temperature (not lower than 1700° C.; e.g., about 1800° C.) in a predetermined atmosphere while being pressed between the pressing dies 65, to thereby become a sintered body 70 as shown in FIG. 8(*c*).

In the firing described above, the calcined body 39' shown in FIG. 7(*b*) is fired while being compressed in the direction along the mating surface 39*a* of the half green bodies 36 and 37, to thereby become the sintered body 70 as shown in FIG. 8(*c*). In FIG. 8(*b*), the green bodies (preliminary green bodies) 34*b*, which is to become the second resistor portions, of the resistor green body 34 are deformed such that the circular cross sections thereof are squeezed along the above-mentioned direction of compression; i.e., along the direction along which the axes J approach each other, to thereby become the second resistor portions 12 each having an elliptic cross section.

The external surface of the thus-obtained sintered body 70 of FIG. 8(*c*) is, for example, polished such that the cross section of the ceramic substrate 13 assumes a circular shape as shown in FIG. 8(*d*), thereby yielding the final heater body 2 (ceramic heater 1). Necessary components, such as the metallic sleeve 3, the electricity-conduction terminal elements 16 and 17, and the metallic shell 4, are attached to the ceramic heater 1, thereby completing the glow plug 50 shown in FIG. 1.

Figure 3:
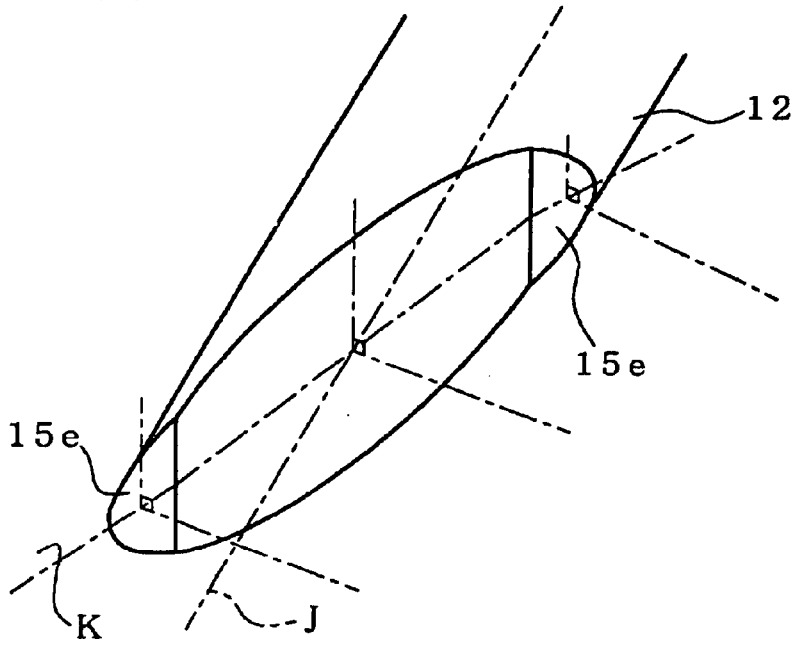
FIGS. 3(*a*) to 3(*c*) are perspective views showing various forms of a joint interface.
Figure 3:
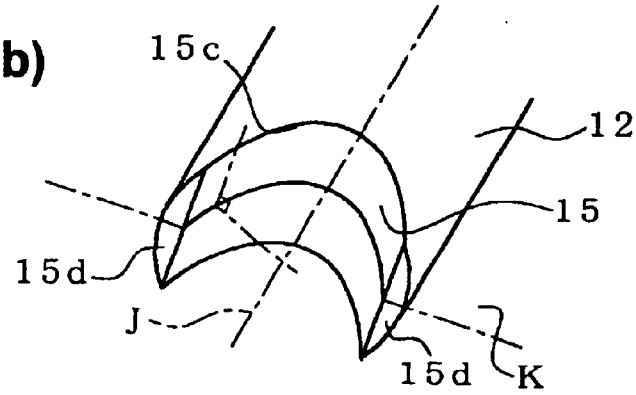
Figure 3:
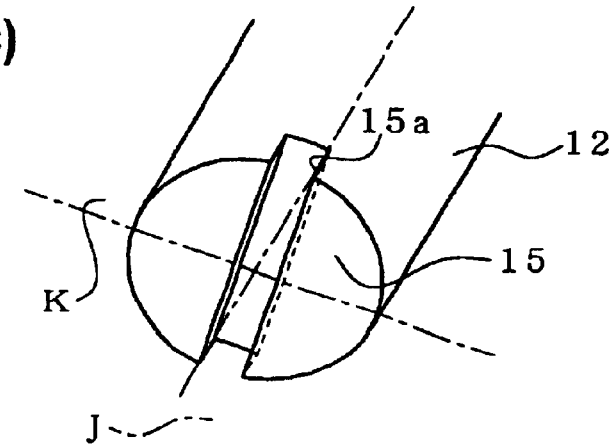
Figure 13:
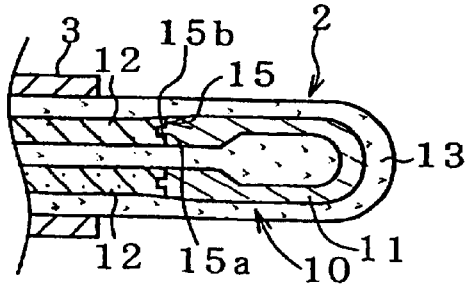
FIG. 13 is a sectional view showing a fifth modification of the front end portion.
Figure 14:
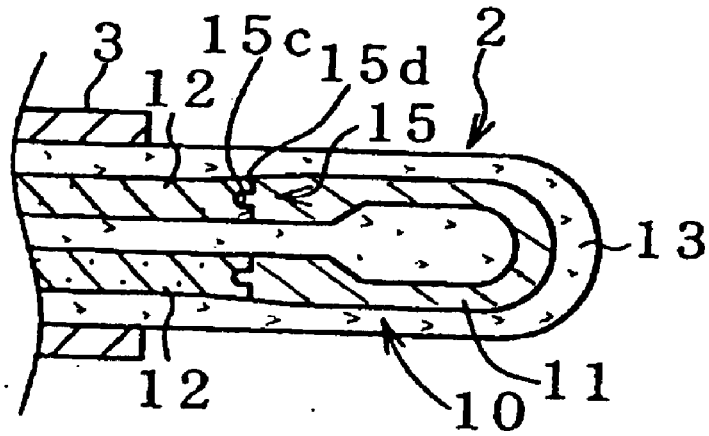
FIG. 14 is a sectional view showing a sixth modification of the front end portion.

The ceramic heater 1 used in the glow plug 50 shown in FIGS. 1 and 2 is configured such that the joint interface 15 of the ceramic resistor 10 includes the inclined plane 15*t*. However, the present invention is not limited thereto. For example, in FIG. 13, a groove 15*a* perpendicularly intersecting the reference plane K is formed on either the first resistor portion 11 or the second resistor portions 12 (on the second resistor portions 12 in the present embodiment), whereas a protrusion 15*b*, which perpendicularly intersects the reference plane K and is engaged with the groove 15*a*, is formed on the other (on the first resistor portion 11 in the present embodiment). FIG. 3(*c*) is a perspective view schematically showing the joint interface 15 on the second resistor portion 12 (on which the groove 15*a* is formed). FIG. 14 shows an example in which the joint interface 15 includes a curved surface 15*c* perpendicularly intersecting the reference plane K, and FIG. 3(*b*) is a perspective view showing the joint interface 15 on the second resistor portion 12. Notably, plane portions 15*d* for dulling the crossing angle θ are formed at the corresponding opposite end portions of the curved surface 15*c*.

It should further be apparent to those skilled in the art that various changes in form and detail of the invention as shown and described above may be made. It is intended that such changes be included within the spirit and scope of the claims appended hereto.

This application is based on Japanese Patent Application No. 2001-135622 filed May 2, 2001, the disclosure of which is incorporated herein by reference in its entirety.

What is claimed is:

1. A ceramic heater, comprising a rodlike heater body (2) configured such that a ceramic resistor (10) formed of an electrically conductive ceramic is embedded in a ceramic substrate (13) formed of an insulating ceramic wherein:

the ceramic resistor (10) comprises a front end part (11*a*) disposed at a front end portion of the heater body (2) and is formed of a first electrically conductive ceramic, and two large-diameter rodlike portions (Ld) joined to two end parts of the front end part (11*a*) as viewed along a direction of electricity supply and forming passages for supplying electricity to the front end part (11*a*), each of the large-diameter rodlike portions (Ld) extending rearward along a direction of an axis (O) of the heater body (2) and having an electricity-supply sectional area greater than that of the front end part (11*a*); and the large-diameter rodlike portions (Ld) each have a connection end part connected to the front end part (11*a*), the connection end part being formed of the first electrically conductive ceramic and constituting a first resistor portion (11) in cooperation with the front end part (11*a*), the remaining portion of each of the large-diameter rodlike portions (Ld) is formed of a second electrically conductive ceramic having an electrical resistivity lower than that of the first electrically conductive ceramic and constitutes a second resistor portion (12), and a joint interface (15) between the first resistor portion (11) and the second resistor portion (12) is located within the corresponding large-diameter rodlike portions (Ld).

2. The ceramic heater (1) as claimed in claim 1, wherein each of the second resistor portions (12) of the ceramic resistor (10) is exposed, from a surface of the heater body (2), at a rear end part thereof as viewed along a direction of the axis (J) to thereby form an exposed part (12*a*), and the exposed part (12*a*) serves as a joint region where an electricity-conduction terminal element is joined to the ceramic resistor.

3. The ceramic heater (1) as claimed in claim 1, wherein at least a portion of the joint interface (15) between the first resistor portion (11) and each of the second resistor portions (12) deviates from a plane (P) perpendicularly intersecting the axis (O) of the heater body (2).

4. The ceramic heater (1) as claimed in claim 2, wherein at least a portion of the joint interface (15) between the first resistor portion (11) and each of the second resistor portions (12) deviates from a plane (P) perpendicularly intersecting the axis (O) of the heater body (2).

5. The ceramic heater (1) as claimed in claim 3, wherein the joint interface (15) comprises an inclined face portion (15*t*), which is inclined with respect to the plane (P) perpendicularly intersecting the axis (O) of the heater body (2).

6. The ceramic heater (1) as claimed in claim 4, wherein the joint interface (15) comprises an inclined face portion (15*t*), which is inclined with respect to the plane (P) perpendicularly intersecting the axis (O) of the heater body (2).

7. The ceramic heater (1) as claimed in claim 5, wherein when a plane including the center axis (O) of the heater body (2) and the axis (J) of the second resistor portion (12) is defined as a reference plane (K), the joint interface (15) including an inclined face portion (15*t*) is formed perpendicularly to the reference plane (K), and the first resistor portion (11) and the second resistor portions (12), which are in contact with each other at the inclined face portion (15*t*), are disposed such that the first resistor portion (11) is located on the outer side of the second resistor portion (12) in a radial direction with respect to the axis (O) of the heater body (2).

8. The ceramic heater (1) as claimed in claim 6, wherein when a plane including the center axis (O) of the heater body (2) and the axis (J) of the second resistor portion (12) is defined as a reference plane (K), the joint interface (15) including an inclined face portion (15*t*) is formed perpendicularly to the reference plane (K), and the first resistor portion (11) and the second resistor portions (12), which are in contact with each other at the inclined face portion (15*t*), are disposed such that the first resistor portion (11) is located on the outer side of the second resistor portion (12) in a radial direction with respect to the axis (O) of the heater body (2).

9. A glow plug (50), comprising:

a ceramic heater (1) as claimed in claim 1;

a metallic sleeve (3) disposed so as to circumferentially surround the heater body (2) of the ceramic heater (1) and such that a front end portion of the heater body (2) projects from the metallic sleeve (3) along the direction of the axis (O); and a metallic shell (4) joined to a rear end portion of the metallic sleeve (3) as viewed along the direction of the axis (O) and having a mounting portion (5) formed on an outer circumferential surface thereof, the mounting portion (5) being adapted to mount the glow plug (50) onto an internal combustion engine.

10. The glow plug (50) as claimed in claim 9, wherein the ceramic resistor (10) is configured such that the joint interface (15) between the first resistor portion (11) and each of the second resistor portions (12) is partially located rearward from a front end edge (3*f*) of the metallic sleeve (3) as viewed along the direction of the axis (O) of the heater body (2).

* * * * *